US006732632B1

(12) United States Patent
Grahle et al.

(10) Patent No.: US 6,732,632 B1
(45) Date of Patent: May 11, 2004

(54) LOST MOULD FOR PRODUCING A CYLINDRICAL BUSHING SLEEVE

(75) Inventors: Peter Grahle, Gerlingen (DE); Jens Wiesenmüller, Lienen (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 12 days.

(21) Appl. No.: 10/148,624

(22) PCT Filed: Nov. 16, 2000

(86) PCT No.: PCT/EP00/11330

§ 371 (c)(1),
(2), (4) Date: May 31, 2002

(87) PCT Pub. No.: WO01/39910

PCT Pub. Date: Jun. 7, 2001

(30) Foreign Application Priority Data

Dec. 2, 1999 (DE) ..... 199 58 185

(51) Int. Cl.[7] ..... B22C 3/00
(52) U.S. Cl. ..... 92/171.1; 164/34

(58) Field of Search ..... 92/171.1, 169.1; 164/34

(56) References Cited

FOREIGN PATENT DOCUMENTS

| | | | | |
|---|---|---|---|---|
| CH | 430065 | * | 8/1967 | |
| DE | 33 37 011 | | 3/1983 | |
| DE | 39 09 521 | | 3/1989 | |
| DE | 198 07 688 | | 9/1999 | |
| EP | 0 421 374 | | 10/1990 | |
| EP | 0 807 479 | | 5/1997 | |
| JP | 01 143737 | | 6/1989 | |
| JP | 02290664 A | * | 11/1990 | ..... B22D/19/00 |
| JP | 02 290664 | | 11/1990 | |

* cited by examiner

*Primary Examiner*—Thomas E. Lazo
(74) *Attorney, Agent, or Firm*—Collard & Roe, P.C.

(57) ABSTRACT

A cylindrical bushing sleeve or another cast part, in particular a ring carrier for pistons, has a rough surface so that the surrounding cast material can cling to the cast part as required. The rough surface is created by producing the cast part with the aid of a lost mold provided with a particulate layer.

6 Claims, 1 Drawing Sheet

LOST MOULD FOR PRODUCING A CYLINDRICAL BUSHING SLEEVE

CROSS REFERENCE TO RELATED APPLICATIONS

Figure 1:
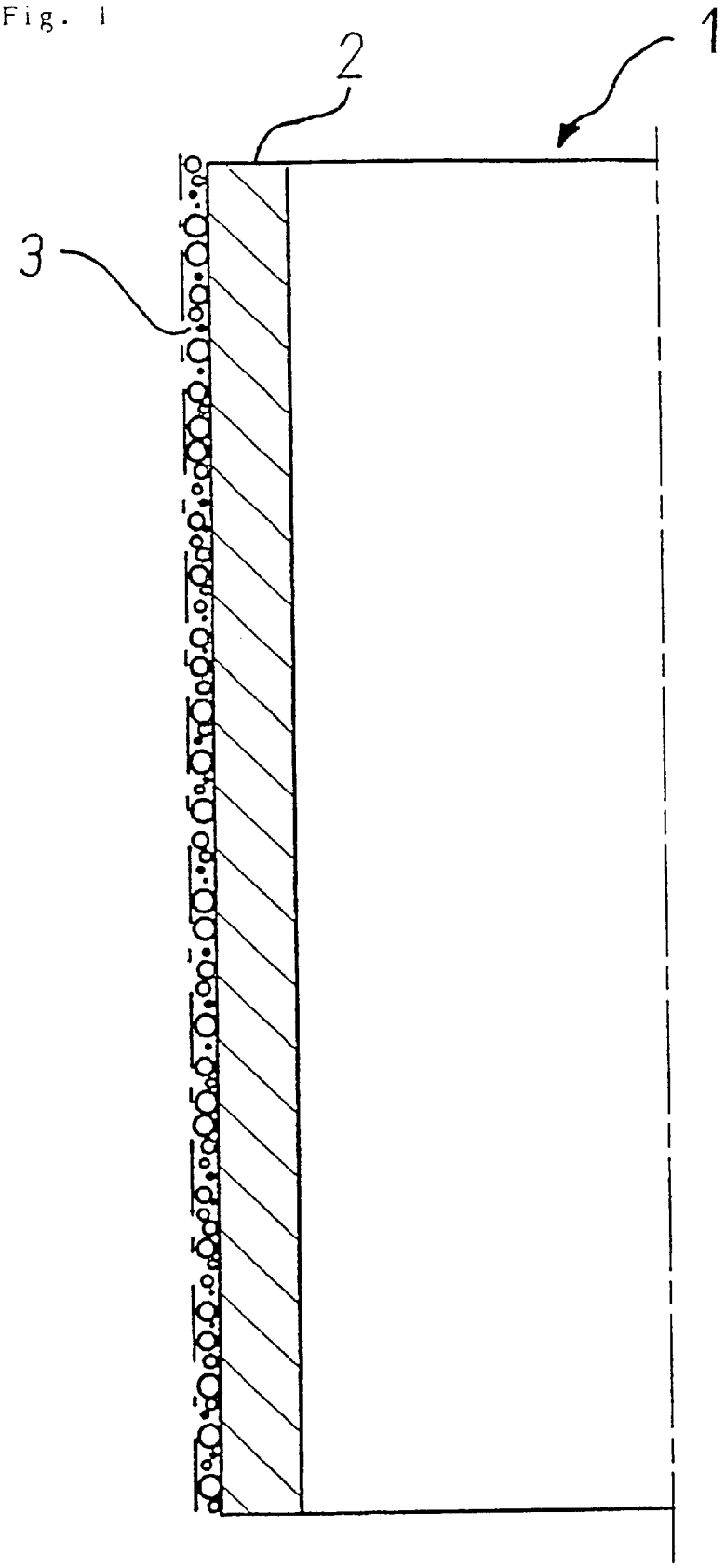

Applicants claim priority under 35 U.S.C. §119 of German Application No. 199 58 185.1 filed Dec. 2, 1999. Applicants also claim priority under 35 U.S.C. §120 of PCT/EP00/11330 filed Nov. 16, 2000. The international application under PCT article 21(2) was not published in English.

The invention relates to a lost mold for production of a cylinder liner or of other cast parts, especially ring carriers for pistons, and to a corresponding production method as well as to cylinder liners produced with inventive lost molds and to a composite of a plurality of cylinder liners and other cast parts.

The production of cylinder liners with lost molds is known in itself from, for example, German Patent (DE) 3909521 A. The production of what are known as rough cast liners from cast iron is also known. In the process the rough surface provided with undercuts is made by a special slip.

A corresponding method for aluminum liners is not yet known.

The invention therefore deals with the problem of providing a method and a corresponding lost mold for production of a cast liner, especially of aluminum, having a rough outside surface.

This problem is solved by a lost mold according to the invention. Advantageous improvements are discussed below.

The inner core of this lost mold and the particles can be made, for example, from polystyrene. Of course, all other materials that are suitable for lost molds can also be considered.

By virtue of the structured surface of the lost mold formed from particles, a rough surface with undercuts is obtained during casting of the liner. During subsequent production of a cylinder block, an aluminum alloy is cast around this surface, thus achieving a clinging effect between liner and base material. The structured surface of the lost mold can also be described as a particle layer permeated with holes on the inner mold of the lost core. An inventive layer differs from the generally common understanding of the word "layer", however, in that cohesion is usually absent between the individual particles forming the layer and exists only between the inner core and the particles. The layer thickness is defined as the radial distance between the surface of the inner core and the extreme outer point of a particle.

The proportion of such holes, or in other words the surface not covered with particles, can have values ranging between 0% and 95% of the total area. Furthermore, it is also possible to provide the particles only locally, for example in an upper and a lower region of the inner core of the lost mold.

It is indeed known from EP 807479 A that a lost-foam core to be provided with a spray-metallized layer can be provided with an intermediate layer of a spray-resistant plastic such as polyamide and, during spraying of the polyamide layer, simultaneously there can be introduced metal particles, which remain as a structured metal layer during outgassing of the polyamide layer and are intended to improve the clinging of the spray-metallized layer to the material cast therearound, but this method is not comparable with the present method. In particular, during production of a corresponding layer by spraying, a good bond between the metal particles present in the intermediate layer and the spray-metallized layer can hardly be developed, since the difference between the melting points of the metal particles and plastic particles is too different.

The invention will be explained in more detail hereinafter on the basis of an example, wherein:

FIG. 1 shows an inventive lost mold in cross section.

Lost mold 1 comprises an inner core 2 and a layer 3, which is formed from particles, contains holes and represents on the whole a structured outer surface of lost mold 1. These particles do not have any cohesion with one another, and thus are bonded only to inner core 2.

Layer 3 formed from particles is applied on inner core 2 by a process in which inner core 2 is first sprayed or painted with an adhesive or in which an adhesive is applied by rolling, after which the inner core is brought into contact with the particles, for example by rolling inner core 2 in a bed of loose particles.

Since the particles are usually round, only point contact with inner core 2 is established in most cases. In a sectional diagram, therefore, a particle that has contact at a point disposed above the plane of the figure can be illustrated diagrammatically as a particle that is not in contact with inner core 2.

The layer thickness of particle layer 3 as defined hereinabove is indicated in the drawing by a broken line.

The particles may have average diameters of 0.5 to 2 mm. The lost mold may be used to make a cylinder liner of hypereutectic AlSi alloy, gray cast iron or cast steel having a structured surface.

What is claimed is:

1. A lost mold for production of a cylinder liner or cylinder-liner composite by casting technology, comprising in particular an aluminum alloy, or for production of a cast part by casting technology, in particular a ring carrier for pistons, the lost mold having an inner core, and being provided in the region of its outside surface with a surface structure having undercuts formed by particles bonded adhesively to the inner core, said particles having average diameters of 0.5 to 2 mm, and said outside surface of the lost mold being coated with a slip.

2. A lost mold according to claim 1, wherein the particles are bonded to the inner core by means of an adhesive.

3. A lost mold according to claim 1, wherein the surface structure is formed on the whole by a particle layer that has lower average density than the density of the inner core.

4. A cylinder liner of hypereutectic AlSi alloy comprising a structured surface created by a lost mold according to claim 1.

5. A cast part, especially a ring carrier for a piston, comprising a structured surface created by a lost mold according to claim 1.

6. A method for production of a lost mold for a cast cylinder liner made of an aluminum alloy and having a rough surface, comprising the steps of producing an inner core of the lost mold in the form of a tubular segment, applying a particle layer onto the inner core, the particles having average diameters of 0.5 to 2 mm and being bonded to the inner core by adhesion and the particle layer having lower density on the whole than the inner core; and coating the lost mold with a slip.

* * * * *